US005681125A

United States Patent [19]

Amaya

[11] Patent Number: 5,681,125

[45] Date of Patent: Oct. 28, 1997

[54] MORTAR APPLICATOR

[76] Inventor: Antonio S. Amaya, 3766 W. Acoma, Phoenix, Ariz. 85023

[21] Appl. No.: 576,124

[22] Filed: Dec. 21, 1995

[51] Int. Cl.[6] ..... B10S 17/005

[52] U.S. Cl. ..... 401/146; 401/28; 401/263; 401/265; 401/48; 401/193; 239/587.4; 222/611.2

[58] Field of Search ..... 401/9, 28, 36–38, 401/48, 193, 146, 263, 265; 239/587.4, 548; 222/611.2, 330, 79, 191, 465.1, 470, 485, 488

[56] References Cited

U.S. PATENT DOCUMENTS

| | | | |
|---|---|---|---|
| 1,399,849 | 12/1921 | Chapin | 401/263 |
| 2,398,985 | 4/1946 | Welch | 401/48 |
| 3,162,886 | 12/1964 | Wise | 222/611.2 X |
| 3,368,234 | 2/1968 | Edens, Jr. | 401/263 |
| 3,775,016 | 11/1973 | Adams | 401/263 X |
| 4,043,487 | 8/1977 | Price | 401/48 X |
| 4,135,651 | 1/1979 | Hession et al. | 401/48 X |

FOREIGN PATENT DOCUMENTS

| | | | |
|---|---|---|---|
| 1082441 | 12/1954 | France | 239/587.4 |
| 375741 | 5/1923 | Germany | 401/263 |

*Primary Examiner*—Danton D. DeMille

*Attorney, Agent, or Firm*—Parsons & Goltry; Robert A. Parsons; Michael W. Goltry

[57] ABSTRACT

A mortar applicator for dispensing mortar for masonry constructions, the mortar applicator including a manifold having a branched passage coupling an inlet aperture to a first and second outlet apertures. A first and second applicator tube are pivotally carried by the manifold in fluid communication with the first and second outlet apertures to dispense mortar on masonry construction in variable widths.

18 Claims, 2 Drawing Sheets

FIG. 1
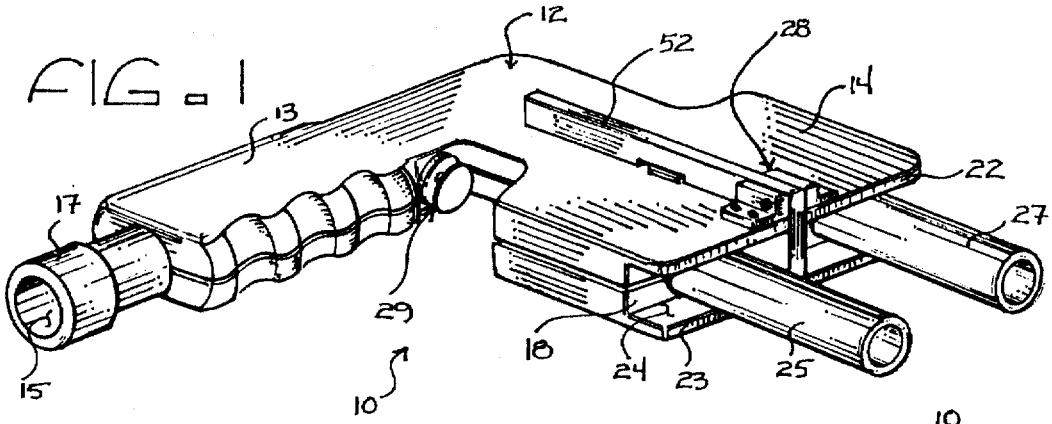
FIG. 2
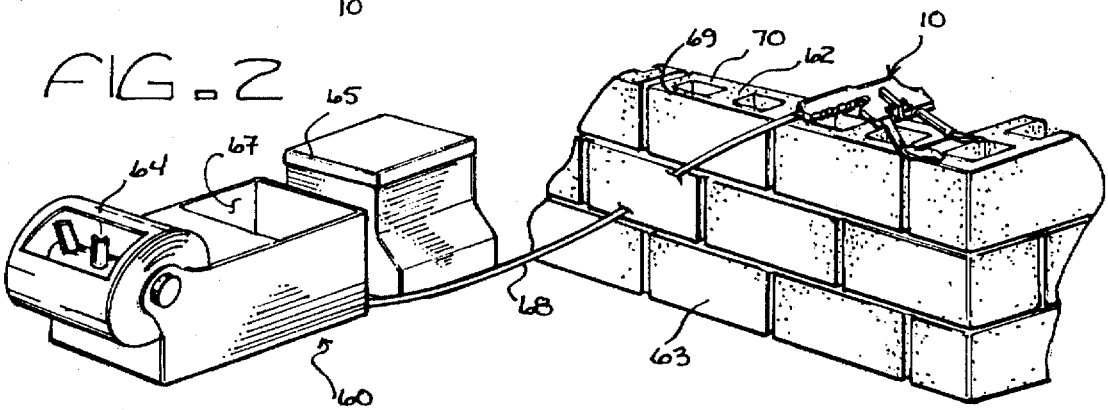
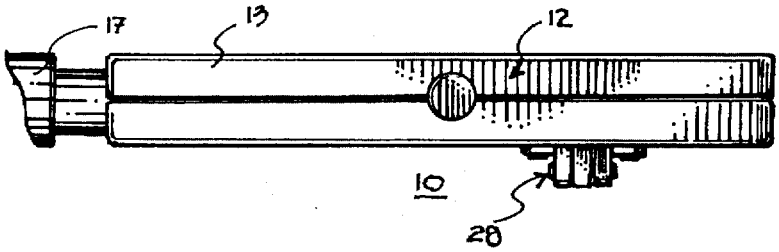
FIG. 3
FIG. 4
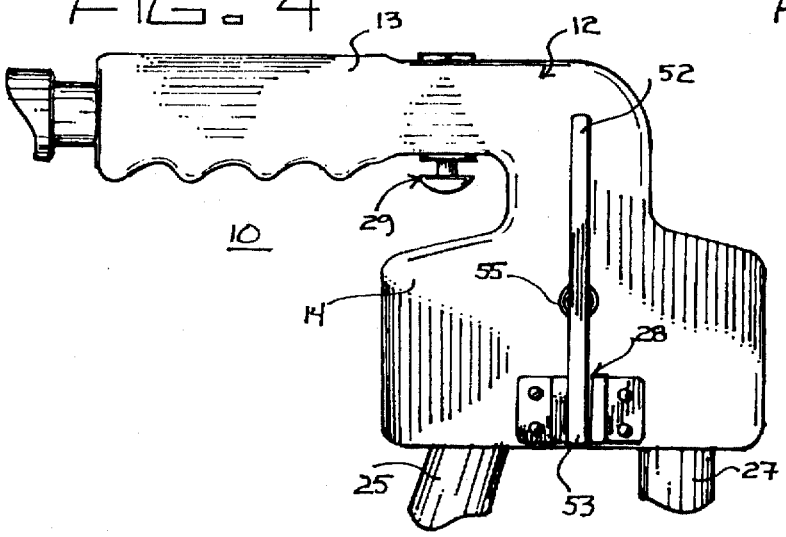
FIG. 5
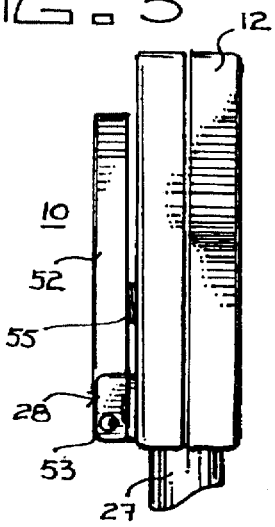

MORTAR APPLICATOR

FIELD OF THE INVENTION

This invention relates to masonry construction.

More particularly, the present invention relates to devices for aiding in masonry construction.

In a further and more specific aspect, the instant invention concerns the application of mortar in masonry construction.

BACKGROUND OF THE INVENTION

Masonry, as a craft has long been known and used, and generally refers to the construction of structures employing stone, clay, brick or concrete block. Since prehistory, stones and bricks have been piled one on another with or without the use of mortar, to form structures. In modern times, masonry is still employed for its color, scale, texture and to provide a look of solidity and permanence. Masonry construction also provides good sound insulation and is fire resistant.

When constructing a structure, a mason will be employed to stack the blocks to form a wall. The blocks are generally joined by a layer of mortar. The mortar is troweled onto the top of a layer of blocks to receive the subsequent layer or row of blocks. Much of the skill in modern masonry is applying the mortar quickly and evenly. The more quickly the mortar can be applied, the more quickly the structure can erected, thereby reducing the cost.

A mason or brick layer is often aided by another individual who mixes and supplies the mortar. This individual carries mortar on a device called a hod. The hod has a pole allowing the individual to raise the mortar to the level of the mason for application. This technique has remained unchanged for many years, so it is a proven method that works. Unfortunately for this method, modern times require a quicker and more efficient method. Mixing and carrying the mortar can occupy two workers if the mason is skilled. The cost of additional workers more than offsets the reduction in cost due to the speed of the mason. This has partly been provided by devices which mechanically mix the mortar, reducing the time needed for hand mixing and eliminating a worker.

It would be highly advantageous, therefore, to remedy the foregoing and other deficiencies inherent in the prior art.

Accordingly, it is an object of the present invention to provide improvements in masonry construction.

Another object of the invention is the provision of a system for supplying mortar to a mason.

And another object of the invention is to provide a device which evenly distributes mortar on a layer of blocks.

Yet another object of the invention is to provide a system for continuously supplying mortar to a masonry construction.

Still another object of the present invention is to provide a device for increasing the speed and efficiency of masonry construction.

SUMMARY OF THE INVENTION

Briefly, to achieve the desired objects of the instant invention in accordance with a preferred embodiment thereof, provided is a mortar applicator for dispensing mortar for masonry constructions, the mortar applicator including a manifold having a first end and a second end, an inlet aperture formed in the first end of the manifold and couplable to a mortar supply, a first outlet aperture and a second outlet aperture formed in the second end of the manifold, each in fluid communication with the inlet aperture, a first applicator tube pivotally carried by the manifold in fluid communication with the first outlet aperture, and a second applicator tube carried by the manifold in fluid communication with the second outlet aperture.

In a further embodiment, included is locking means for securing the first applicator tube in a desired orientation. One specific embodiment of the locking means includes a locking lever moveable between a release position in which position the locking lever widens the manifold at the first applicator tube allowing pivoting thereof, and a locking position in which position the manifold frictionally engages and securely retains the first applicator tube.

In yet a further embodiment, a trigger valve carried by the manifold proximate the inlet aperture, the trigger valve moveable between an open position allowing fluid flow through the branching passage, and a closed position preventing fluid flow through the branched passage.

In still a further embodiment, A mortar applicator system for dispensing mortar to a masonry construction is provided. The system includes a mortar applicator and a mortar supply. The mortar supply includes a mixing device, a reservoir coupled to the mixing device, and a pump coupled to the reservoir. A conduit couples the reservoir to the mortar applicator through the pump.

BRIEF DESCRIPTION OF THE DRAWINGS

The foregoing and further and more specific objects and advantages of the instant invention will become readily apparent to those skilled in the art from the following detailed description of a preferred embodiment thereof taken in conjunction with the drawings, in which:

FIG. 1 is a perspective view of a mortar applicator constructed in accordance with the teachings of the present invention;

FIG. 2 is a perspective view illustrating a mortar applicator system as it would appear applying mortar to a masonry structure;

FIG. 3 is a top plan view of the mortar applicator of FIG. 1;

FIG. 4 is a side plan view of the mortar applicator of FIGS. 1 and 3;

FIG. 5 is an end plan view of the mortar applicator of FIGS. 1, 3 and 4;

DETAILED DESCRIPTION OF THE PREFERRED EMBODIMENT

Figure 6:
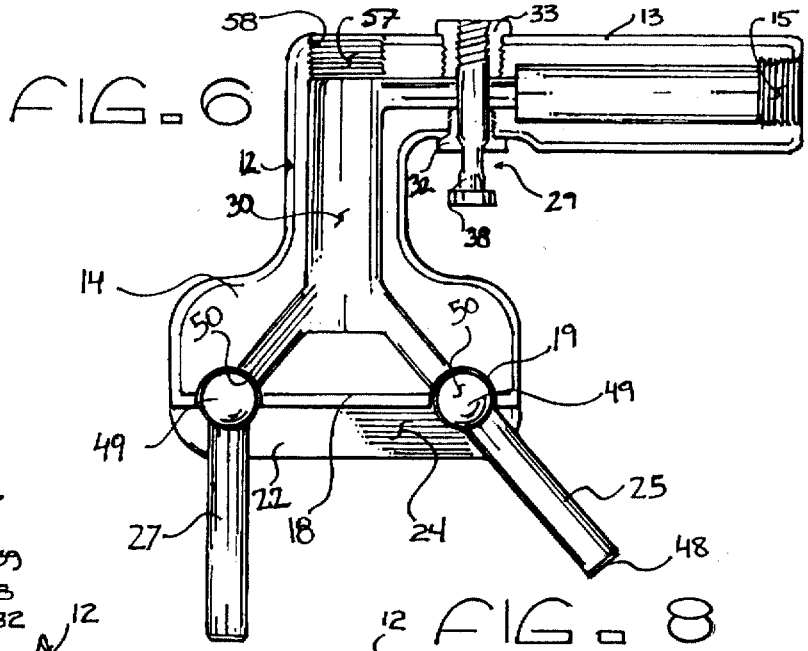
FIG. 6 is a sectional view taken along line 6—6 of FIG. 1.

Turning now to the drawings in which like reference characters indicate corresponding elements throughout the several views. Attention is first directed to FIGS. 1 and 3–5 which illustrate a mortar applicator generally designated 10. Mortar applicator 10 includes a manifold 12 having an end 13 and an end 14. In this specific embodiment, manifold 12 is generally pistol shaped, with end 13 in the form of a grip, and end 14 at a right angle thereto. End 13 terminates in an inlet aperture 15 fitted with a coupling 17 for receiving a conduit from a mortar supply. The conduit and mortar supply will be described presently. End 14 terminates in an end surface 18 defining a pair of spaced apart outlet apertures 19 and 20 (visible in FIG. 6). A pair of parallel flanges 22 and 23 extend from end 14 defining a groove 24, the bottom of which is end surface 18.

Also included in mortar applicator 10 is a pair of spaced apart applicator tubes 25 and 27 pivotally carried within groove 24 for dispensing mortar, a locking mechanism 28 for securing applicator tubes 25 and 27 in a desired orientation, and a trigger valve 29 for opening and closing a passage between inlet aperture 15 and outlet apertures 19 and 20.

Turning now to FIG. 6, manifold 12 includes a branching passage 30 coupling inlet aperture 15 to both outlet apertures 19 and 20, and permitting fluid communication therebetween. The branching of branched passage 30 occurs proximate end 14, thereby leaving a single passage proximate end 13. The single passage can be closed by trigger valve 29. Trigger valve 29 is positioned at the grip portion of manifold 12 to permit ease in opening and closing during use of mortar applicator 10. An access opening 57 in communication with branched passage 30, closed by a stopper 58 is provided intermediate end 13 and end 14 to permit access to branched passage for ease in cleaning.

Figure 7:
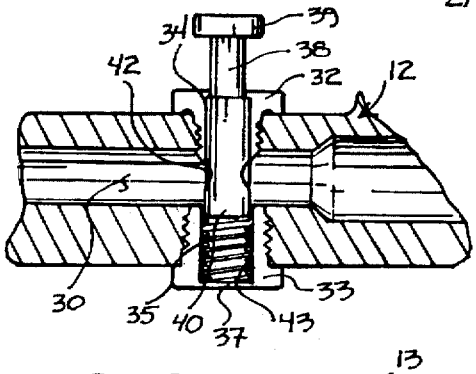
FIG. 7 is an enlarged partial view illustrating a trigger valve of the mortar applicator.
Figure 8:
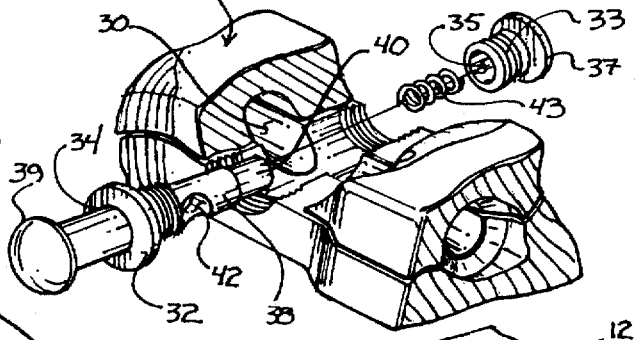
FIG. 8 is an exploded view of the trigger valve of the mortar applicator.

With additional reference to FIGS. 7 and 8, trigger valve 29 includes a pair of bushings 32 and 33 threaded into openings formed in manifold 12. Bushing 32 includes a bore 34 extending completely therethrough, and bushing 33 includes a bore 35 closed at one end by an end wall 37. Bores 34 and 35 of Bushings 32 and 33 are coaxially aligned such that the axis of each intersects branched passage 30 at the single passage portion. A plug 38 having an end 39, an end 40 and an aperture 42 therethrough intermediate end 39 and end 40, is coaxial received by bore 34 and bore 35, and thus also intersects branched passage 30. A compression spring 43 is positioned between end 43 and end wall 37. The diameter of plug 38 is substantially equal to the diameter of branched passage 30 at the single passage portion. When depressed, or in other words, when plug 38 is pressed into manifold 12 so as to compress spring 43, aperture 42 is moved from branched passage 30 into bore 35 of bushing 33, closing branched passage 30 and preventing fluid movement therethrough. On releasing plug 38, spring 43 expands, biasing plug 38 outward, and thereby aligning aperture 42 with branched passage 30 and permitting fluid flow therethrough.

Figure 10:
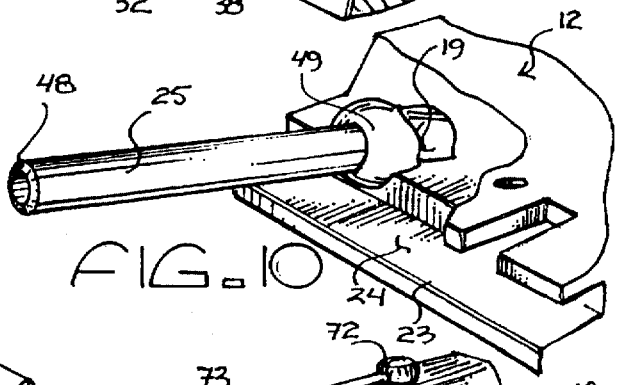
FIG. 10 is a partial broken away view illustrating the adjustability of the applicator tubes.

With continued reference to FIG. 6, applicator tubes 25 and 27 each have a dispensing end 48 and a ball end 49. Ball end 49 of each of applicator tubes 25 and 27 includes an opening 50 in fluid communication with outlet apertures 19 and 20. Outlet apertures 19 and 20 are each formed as sockets to receive and permit rotation of ball ends 49 of applicator tubes 25 and 27. With additional reference to FIG. 10, it can be seen that ball end 49 of each applicator tube 25 and 27 forms a ball and socket joint with each of outlet apertures 19 and 20. Opening 50 in ball end 49 of each applicator tube 25 and 27 must remain in fluid communication with outlet apertures 19 and 20 and thus branching passage 30 after reorientation thereof. This may be accomplished using slightly enlarged openings or slot shaped openings. It should be understood that while the openings must be large enough to maintain fluid communication, they cannot be so large as to become exposed at the limits of the pivotal movement, or leaking will occur.

Figure 11:
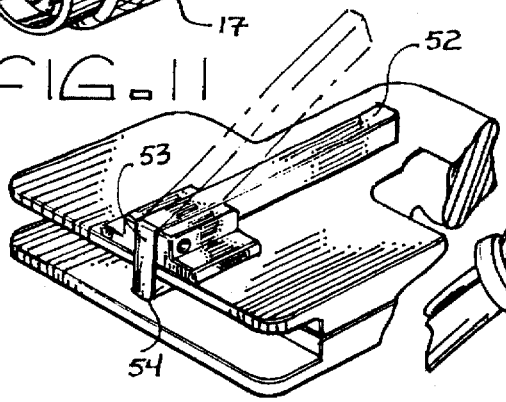
FIG. 11 is partial perspective view illustrating a locking lever for releasably retaining the applicator tubes.

Turning now to FIG. 11, locking mechanism 28 is utilized to permit pivoting of applicator tubes 25 and 27 for reorientation when desired and to prevent movement when a desired orientation has been achieved. Locking mechanism 28 includes a lever 52 hingedly coupled by an end 53 at, end 14 and extending along manifold 12 toward end 13. A contact member 54 is coupled to end 53 of lever 52 and extends between flanges 22 and 23. Lever 52 is movable between a locking position, in which position flanges 22 and 23 of manifold 12 frictionally engage and securely retain applicator tubes 25 and 27, and a release position in which contact member 54 forces flanges 22 and 23 apart, in essence widening manifold 12 at applicator tubes 25 and 27, thus relieving the frictional engagement and allowing pivoting thereof. In this embodiment, the release position involves pulling lever 52 away from manifold 12, pressing contact member 54 against flanges 22 and 23 and causing separation. The locking position involves keeping locking lever 52 adjacent manifold 12. To ensure that application tubes 25 and 27 are retained when desired, a spring 55 is coupled between locking lever 52 and manifold 12 to bias locking lever 52 against manifold 12. To release applicator tubes 25 and 27, this bias must be overcome. One skilled in the art will understand that other locking devices may be employed, such as locking pins, ratchets, etc.

Figure 9:
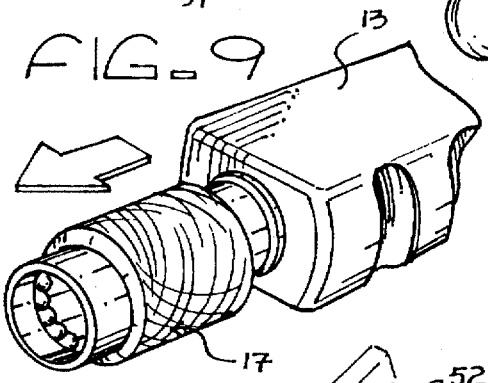
FIG. 9 is an enlarged perspective view of a hose coupling.

Turning now to FIG. 2, a mortar applicator system generally designated 60 is illustrated as it would appear applying mortar to a top surface 62 of a masonry construction 63. System 60 includes mortar applicator 10, a mortar mixer 64, a pump 65 a reservoir 67, and a conduit 68 coupling reservoir 67 to inlet aperture 15 of mortar applicator 10. Conduit 68 may simply be a hose extending from pump 65 and coupled to mortar applicator 10 by coupling 17 as illustrated in FIG. 9. In this instance a quick disconnect coupling, well known in the art, is illustrated. However, one skilled in the art will appreciate that many different types of couplers may be employed.

In this specific example, masonry construction 63 is formed of cement blocks having interior spaces separating sides 69 and 70. It will be understood by those skilled in the art that system 60 may be employed in masonry construction utilizing other materials such as bricks, stone, etc. Mixer 64, pump 65 and reservoir 67 may be any of a number of conventional devices employed in different fields, such as the application of stucco, or cement for example. Devices employing these three elements are readily available from Ingersoll-Dresser Pump Co. of Liberty Corner, N.J., Quick Spray of Port Clinten, Ohio, and Widen of Grand Terrace, Calif. as a few examples.

Masonry constructions vary in width depending upon the material used. To continue the example illustrated in FIG. 2, sides 69 and 70 may be separated by different distances. To adequately cover top surface 62, sufficient mortar must be applied proximate sides 69 and 70. The application of parallel beads or lines of mortar permits a uniform layer to be formed on top surface 62 by judicious use of a trowel. In the specific example illustrated, the central portion of top surface 62 is pierced by a plurality of wide openings. Therefore, the layer of mortar can only be evenly distributed on sides 69 and 70.

Mortar applicator 10 has been developed to provide a constant supply of mortar to top surface 62 through applicator tubes 25 and 27. In order for the mortar to be dispensed proximate the sides of the top surface of constructions having different widths, applicator tubes 25 and 27 can be pivoted to increase or decrease the distance between dispensing ends 48 thereof.

Figure 12:
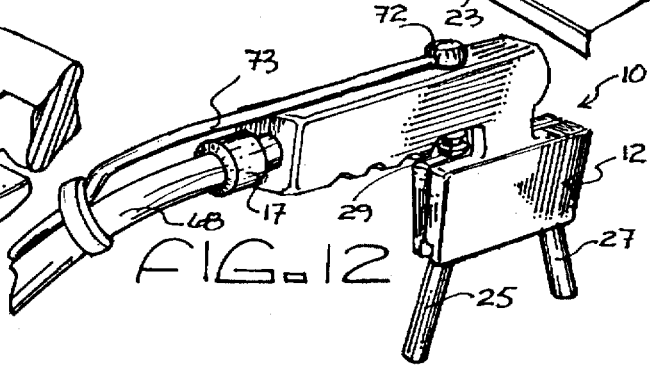
FIG. 12 is a perspective view of a pressure control switch coupled to the mortar applying system.

Referring to FIG. 12, an additional feature has been added to system 60. A pressure sensor 72 is coupled to mortar applicator 10 at trigger valve 29. This sensor can be coupled to pump 65 by a control conduit 73 to slow or stop the pump when a predetermined pressure is reached, to prevent damage or injury.

Various changes and modifications to the embodiments herein chosen for purposes of illustration will readily occur to those skilled in the art. To the extent that such modifications and variations do not depart from the spirit of the invention, they are intended to be included within the scope thereof which is assessed only by a fair interpretation of the following claims.

Having fully described the invention in such clear and concise terms as to enable those skilled in the art to understand and practice the same, the invention claimed is:

1. A mortar hand held applicator system for dispensing mortar to a masonry construction, the system comprising:

a mortar applicator including;
- a manifold having a first end and a second end;
- an inlet aperture formed in the first end of the manifold; and
- a first outlet aperture and a second outlet aperture formed in the second end of the manifold, each in fluid communication with the inlet aperture;

a mortar supply including;
- a mixing device;
- a reservoir coupled to the mixing device; and
- a pump coupled to the reservoir; and a conduit coupling the reservoir to the mortar applicator through the pump.

2. A system as claimed in claim 1 wherein the mortar applicator further includes a first applicator tube pivotally carried by the manifold in fluid communication with the first outlet aperture, and a second applicator tube carried by the manifold in fluid communication with the second outlet aperture.

3. A system as claimed in claim 1 wherein the mortar applicator further includes a branching passage through the manifold, the branching passage coupling the inlet aperture to the first outlet aperture and to the second outlet aperture.

4. A system as claimed in claim 3 wherein the mortar applicator further includes locking means for securing the first applicator tube in a desired orientation.

5. A system as claimed in claim 3 wherein the locking means includes a locking lever moveable between a release position in which position the locking lever widens the manifold at the first applicator tube allowing pivoting thereof, and a locking position in which position the manifold frictionally engages and securely retains the first applicator tube.

6. A system as claimed in claim 3 wherein the second applicator tube is pivotally carried by the manifold in fluid communication with the second outlet aperture.

7. A system as claimed in claim 3 wherein the mortar applicator further includes a trigger valve carried by the manifold proximate the inlet aperture, the trigger valve moveable between an open position allowing fluid flow through the branching passage, and a closed position preventing fluid flow through the branched passage.

8. A hand held mortar applicator comprising:

a manifold for receiving a flow of mortar and having a first end and a second end;

an inlet aperture formed in the first end of the manifold and couplable to a remote mortar supply by a conduit for a pressure feed of mortar;

a first outlet aperture and a second outlet aperture formed in the second end of the manifold, each in fluid communication with the inlet aperture;

a first applicator tube pivotally carried by the manifold in fluid communication with the first outlet aperture; and a second applicator tube spaced from the first applicator tube and carried by the manifold in fluid communication with the second outlet aperture, the pivotal characteristic of the first applicator permitting adjustment of the spacing between the first applicator tube and the second applicator tube.

9. A mortar hand held applicator as claimed in claim 8 further including a branching passage through the manifold, the branching passage coupling the inlet aperture to the first outlet aperture and to the second outlet aperture.

10. A mortar hand held applicator as claimed in claim 9 further including locking means for securing the first applicator tube in a desired orientation.

11. A mortar hand held applicator as claimed in claim 10 wherein the locking means includes a locking lever moveable between a release position in which position the locking lever widens the manifold at the first applicator tube allowing pivoting thereof, and a locking position in which position the manifold frictionally engages and securely retains the first applicator tube.

12. A mortar hand held applicator as claimed in claim 11 further comprising a trigger valve carried by the manifold proximate the inlet aperture, the trigger valve moveable between an open position allowing fluid flow through the branching passage, and a closed position preventing fluid flow through the branched passage.

13. A mortar hand held applicator as claimed in claim 11 wherein the second applicator tube is pivotally carried by the manifold in fluid communication with the second outlet aperture and locked and released by the locking means.

14. A hand held applicator comprising:

A manifold for receiving a flow of mortar and having a first end and a second end;

an inlet aperture formed in the first end of the manifold and couplable to a remote mortar supply by a conduit for a pressure feed of mortar;

a first outlet aperture and a second outlet aperture formed in the second end of the manifold, each in fluid communication with the inlet aperture;

a first applicator tube pivotally carried by the manifold in fluid communication with the first outlet aperture;

a second applicator tube spaced from the first applicator tube and carried by the manifold in fluid communication with the second outlet aperture, the pivotal characteristic of the first applicator permitting adjustment of the spacing between the first applicator tube and the second applicator tube; and a branching passage through the manifold, the branching passage coupling the inlet aperture to the first outlet aperture and to the second outlet aperture;

whereby an individual working alone can manipulate the mortar applicator by hand to dispense a double row of mortar, the double row of mortar being adjustably spaced apart by pivotal adjustment of the first applicator tube.

15. A mortar hand held applicator as claimed in claim 14 further including locking means for securing the first applicator tube in a desired orientation.

16. A mortar hand held applicator as claimed in claim 14 wherein the locking means includes a locking lever moveable between a release position in which position the locking lever widens the manifold at the first applicator tube allowing pivoting thereof, and a locking position in which position the manifold frictionally engages and securely retains the first applicator tube.

17. A hand held mortar applicator as claimed in claim 14 wherein the second applicator tube is pivotally carried by the manifold in fluid communication with the second outlet aperture to facilitate adjustment of the spacing between the first applicator tube and the second applicator tube.

18. A mortar hand held applicator as claimed in claim 14 further comprising a trigger valve carried by the manifold proximate the inlet aperture, the trigger valve moveable between an open position allowing fluid flow through the branching passage, and a closed position preventing fluid flow through the branched passage.

* * * * *